US007052372B2

(12) United States Patent
Lim et al.

(10) Patent No.: US 7,052,372 B2
(45) Date of Patent: May 30, 2006

(54) CHEMICAL-MECHANICAL POLISHER HARDWARE DESIGN

(75) Inventors: Seng-Keong Victor Lim, Singapore (SG); Paul Richard Proctor, Singapore (SG); Robert Chin Fu Tsai, Singapore (SG)

(73) Assignee: Chartered Semiconductor Manufacturing, LTD, Singapore (SG)

( * ) Notice: Subject to any disclaimer, the term of this patent is extended or adjusted under 35 U.S.C. 154(b) by 433 days.

(21) Appl. No.: 10/014,085

(22) Filed: Dec. 13, 2001

(65) Prior Publication Data

US 2003/0114086 A1 Jun. 19, 2003

(51) Int. Cl.
*B24B 1/00* (2006.01)

(52) U.S. Cl. ..... 451/41; 451/60; 451/63; 451/287; 451/288; 451/289; 451/262

(58) Field of Classification Search ..... 451/41, 451/60, 63, 287, 288, 260, 289, 262
See application file for complete search history.

(56) References Cited

U.S. PATENT DOCUMENTS 4,750,915 A * 6/1988 Tomita et al. ..... 51/298
5,482,497 A * 1/1996 Gonnella et al. ..... 451/57
5,542,874 A 8/1996 Chikaki
5,928,062 A 7/1999 Miller et al.
5,975,997 A * 11/1999 Minami ..... 451/287
6,159,083 A 12/2000 Appel et al.
6,183,345 B1 2/2001 Kamomo et al.
6,203,408 B1 3/2001 Quek
6,234,868 B1 5/2001 Easter et al.
6,241,585 B1 6/2001 White
6,273,796 B1 8/2001 Moore
6,290,883 B1 * 9/2001 Crevasse et al. ..... 264/50
6,530,827 B1 * 3/2003 Mitsuhashi ..... 451/72

* cited by examiner

*Primary Examiner*—Shantese McDonald
(74) *Attorney, Agent, or Firm*—William J Stoffel

(57) ABSTRACT

A polish apparatus for planarizing wafers and films over wafers comprising the following. A substrate chuck for holding a substrate with a surface to be polished thereof being directed about vertically. A first drive means for rotating the substrate chuck. A polishing head having a polishing surface which is adjacent to the substrate during the polishing of the substrate. The polishing surface of the polishing head is smaller than the surface of the substrate. A polishing solution supply means for supplying a polishing solution through the polishing head to the substrate held by the substrate chuck. A reciprocating means for reciprocally moving the polishing head on the surface to be polished. A pressing means for pressing the polishing pad against a substrate held by the substrate chuck by way of the polishing head. The polish head is preferably comprised of one piece of molded polymer. No polish pad is used.

46 Claims, 3 Drawing Sheets

CHEMICAL-MECHANICAL POLISHER HARDWARE DESIGN

BACKGROUND OF INVENTION

1) Field of the Invention

The present invention relates to a polishing apparatus, and more particularly to a substrate polishing apparatus for polishing a wafer or substrate in the process of fabricating a semiconductor integrated circuit.

2) Description of the Prior Art

In conventional chemical-mechanical polish (CMP) tools, the wafer is secured and spins on a horizontal orientation while pressing against a CMP polish pad to achieve a global planarization. Due to the total thickness variation (TTV) of the wafer, the contour of the incoming wafer can be concave, convex, taper or of any other irregular pattern. As a result of this wafer the total thickness variation (TTV), subsequent film deposition will follow this contour, hence resulting in non-uniform film thickness after chemical-mechanical polish (CMP). This problem can arise due to the conventional top ring design, whereby a constant down force is applied to the entire wafer causing localized wafer warpage. Hence, this results in very poor material removal uniformity.

Equipment manufactures are trying to solve this non-uniformity problem by introducing more advanced and complex top rings with variable backside pressure on different zones of the wafer. All these measures add cost and have limited effectiveness. Conventional polishers also suffer from non-uniform slurry distribution where less slurry is delivered the wafer center as compared to the wafer edges. This results in higher polish rates on the edges.

The importance of overcoming the various deficiencies noted above is evidenced by the extensive technological development directed to the subject, as documented by the relevant patent and technical literature. The closest and apparently more relevant technical developments in the patent literature can be gleaned by considering: U.S. Pat. No. 5,542,874(Chikaki), U.S. Pat. No. 5,928,062(Miller et al.), U.S. Pat. No. 6,183,345B1(Kamomo et al.), U.S. Pat. No. 6,203,408B1(Quek), U.S. Pat. No. 6,234,868B1(Easter et al.), U.S. Pat. No. 6,159,083(Appel et al.), U.S. Pat. No. 6,273,796B1(Moore), and U.S. Pat. No. 6,241,585B1 (White) that show CMP polisher designs.

However, these polisher designs can be further improved.

SUMMARY OF THE INVENTION

It is an object of the present invention to provide a polishing apparatus which provides superior planarization across irregular surface and curved wafer surfaces.

It is an object of an embodiment of the present invention to provide a polishing apparatus which comprises a polymer polishing surface that does not use a polish pad.

It is an object of an embodiment of the present invention to provide a polishing apparatus which has a vertically oriented polish head, the polish head smaller in area than the substrate or wafer, and the polymer polish head contacts the surface to be polished and does not use a polish pad.

To accomplish the above objectives, the present invention provides a polishing apparatus for planarizing wafers and films over wafers.

In a preferred embodiment, the wafer polishing apparatus comprises: a polishing head having a polishing surface which is adjacent to or contacting a surface over a substrate during the polishing of the wafer; the polishing surface of the polishing head is smaller than the substrate surface; and the polishing surface is comprised of a polymer. No polish pad is used. Preferably, the polishing surface has an about vertical orientation.

A preferred embodiment of a wafer polishing apparatus comprises the following: a wafer chuck for holding a wafer with a surface to be polished thereof being directed vertically; a first drive means for rotating the wafer chuck; a polishing head having a polishing surface which is adjacent to the wafer during the polishing of the wafer; the polishing surface of the polishing head is smaller than the surface of the wafer; a polishing solution supply means for supplying a polishing solution through the polishing head to the wafer held by the wafer chuck; a reciprocating means for reciprocally moving the polishing head on the surface to be polished; and a pressing means for pressing the polishing pad against a wafer held by the wafer chuck by way of the polishing head.

In another aspect of the invention, the polishing head has an area between 5 and 15% of the surface area of the wafer.

In another aspect of the invention, the apparatus includes a diamond disk conditioning device.

Additional objects and advantages of the invention will be set forth in the description that follows, and in part will be obvious from the description, or may be learned by practice of the invention. The objects and advantages of the invention may be realized and obtained by means of instrumentalities and combinations particularly pointed out in the appended claims.

BRIEF DESCRIPTION OF THE DRAWINGS

The features and advantages of a polishing apparatus according to the present invention and further details of a process of fabricating a semiconductor device in accordance with the present invention will be more clearly understood from the following description taken in conjunction with the accompanying drawings in which like reference numerals designate similar or corresponding elements, regions and portions and in which.

DETAILED DESCRIPTION OF THE PREFERRED EMBODIMENTS

Preferred embodiments of the present invention will be described in detail with reference to the accompanying drawings. The present invention provides an apparatus for chemical-mechanical polishing (CMPing) objects and preferably for planarizing films over wafers.

Figure 1:
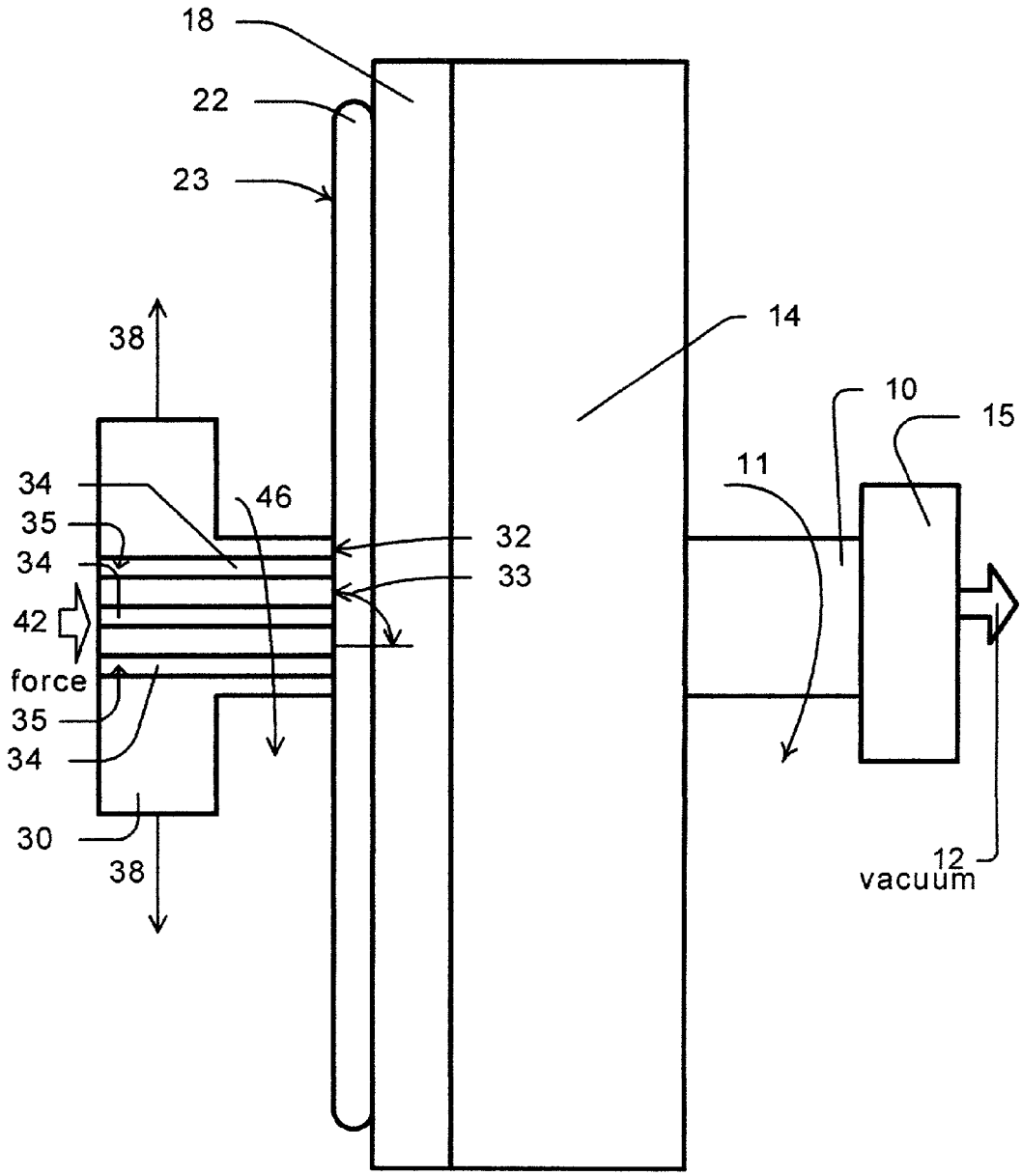
FIG. 1 is a front elevational view of a preferred embodiment of the wafer polishing apparatus of the present invention.

As shown in FIG. 1, a preferred embodiment of the invention is a wafer polishing apparatus. FIG. 1 shows a wafer chuck 14 for holding a wafer or semiconductor structure 22. The apparatus preferably about vertically orientates the wafer with a surface to be polished and the polishing surface 32 of the polish head 30. The surface of the wafer can be comprised of materials used in semiconductor manufacturing, such as semiconductor materials, silicon, insulating materials, dielectric materials, and conductive materials. Wafer can include substrates of all kinds used in semiconductor or electronics manufacturing and can comprise films over the substrate or wafer. Substrate can comprise any material used in semiconductor or electronics fabrication and any films over the substrate.

A vacuum means 12 is preferably used to apply a vacuum to hold the wafer in the wafer chuck. A vacuum device with can draw a vacuum. The vacuum can pass through passageways in the spindle 10 through the wafer chuck.

The wafer chuck 14 can be rotated by a first drive means 11. The first drive means can be a rotation motor 15 connected to the spindle 10. The wafer chuck 14 is preferably rotated at a speed between 50 and 2000 revolutions per minute (rpm).

The wafer chuck can have a membrane 18 contacting the wafer 22. The membrane is preferably comprised of soft polymer. The membrane 18 preferably contacts with the wafer during polishing.

Polish Head

The polish head 30 has a polishing surface 32 which is adjacent to or contacting the wafer 32 during the polishing of the wafer. The polish head is hard and small and will not bend. This results in better CMP removal uniformity. In contrast, a conventional polishing pad will deform or bend during polishing thereby causing the removal uniformity to be poor.

A key feature of the invention is that the polishing surface 32 of the polishing head 30 is smaller than the surface of the wafer 22. The polishing head 30 preferably has an area between 10 and 20% and more preferably 5 and 15% of the area of the total surface to be polished of the wafer 22.

Another key feature of the embodiment is that the polish head and polish surface 32 are preferably about vertically orientated. The polish surface 32 can be inclined relative to the horizontal by an angle 33. For example, the polish head can be about vertical as shown in FIG. 1. Alternately, angle 33 can be any value less than 90° and greater than about 1 degree relative to horizontal. Preferably the angle 33 is between about 75 and 90 degrees and more preferably between 88 and 90 degrees. The polishing surface is orientated at an angle to the vertical between about 0 and 15 degrees and more preferably between about 0 and 2 degrees.

Materials of the Polish Head

The polishing head 30 is preferably comprised of polyurethane or other polymer. A key difference between this embodiment and conventional CMP head is that the invention does not use a polish pad. The embodiment's polymer head polishes the wafer surface.

The polishing head 30 is preferably one piece. The polish head comprised of polyurethane or other polymer can be molded. The polishing head can be solid and has channel and passage ways in the solid piece.

Figure 4:
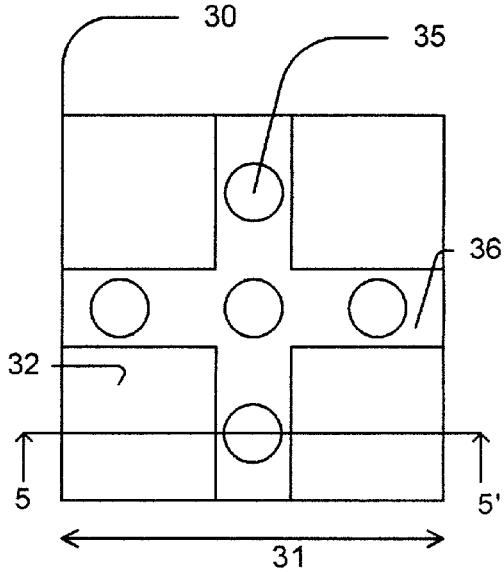
FIG. 4 is a cross sectional view along axis 4/4' in FIG. 3 of the polisher head of a preferred embodiment of the wafer polishing apparatus of the present invention.

FIG. 4 shows an end view of the bottom or polishing surface side of the polish head. As shown in FIG. 4, the polishing surface 32 of the polish head preferably has grooves 36 to allow the polishing solution to flow across the polishing surface and the wafer. The grooves preferably have a depth between 5 and 10 mm and a width between 2 and 6 mm.

Figure 5:
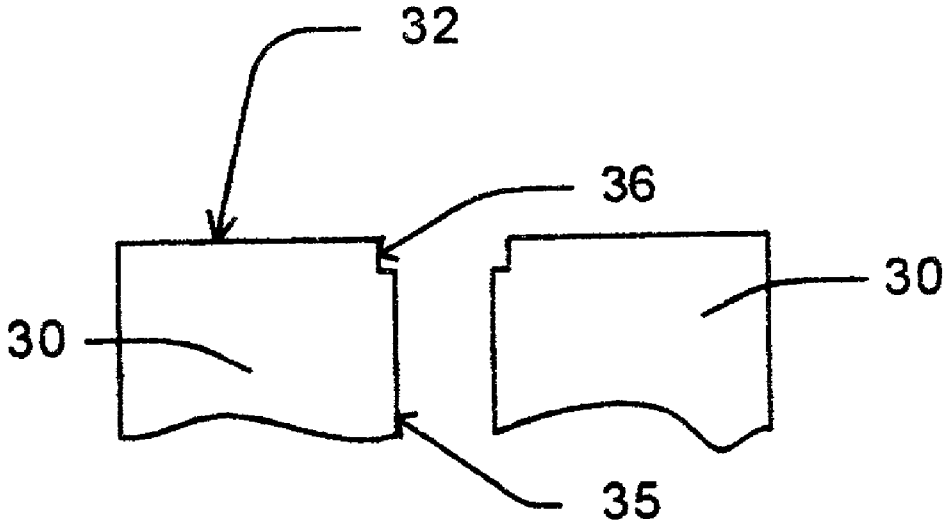
FIG. 5 is a cross sectional view along axis 5/5' in FIG. 4 of the polisher head of a preferred embodiment of the wafer polishing apparatus of the present invention.

As shown in FIG. 4, the polish head preferably has a square shaped polishing surface 32. The square shaped polishing surface 32 had an overall length and width 31 of between 2 and 5 cm. The polish head can have any other shapes such as circular, elliptical, rectangular, etc. The grooves 36 preferably form a cross pattern as shown in FIG. 4. FIG. 5 shows a cross sectional view across axis 5/5' in FIG. 4.

Polishing Solution Supply Device

Referring back to FIG. 1, the apparatus further comprises a polishing solution supply means 34 for supplying a polishing solution through the polishing head 30 to the wafer 22 held by the wafer chuck. The polish solution supply means can be a solution reservoir connected by channels to the passages 35 in the polish head and a pump to cause the solution to flow. The amount of slurry that pass through each individual passage 35 can be individually controlled to ensure the proper slurry distribution across the polish head and wafer. The wafer rotates and a thin layer of slurry is distributed evenly across the wafer surface adjacent to the polish head.

Reciprocating Device

The polishing apparatus also has a reciprocating means 38 for reciprocally moving the polishing head 30 on the surface to be polished 23. A reciprocating arm and motor can comprise the reciprocating means 38 as is conventional in the art. The reciprocating device preferably moves the polish head in a linear motion from top to bottom or bottom to top of the wafer. The reciprocating device brings the polish head over the entire surface of the wafer.

The polishing apparatus also can have an optional second drive means 46 for rotating the polishing head 30. The optional second drive means 46 can be comprised of a rotation motor connected to the polish head 30. The second drive device can be used to control the CMP removal rate and removal uniformity.

Pressing Device

The polishing apparatus also has a pressing means 42 for pressing the polishing head 3O against a wafer 22 held by the wafer chuck 14. The pressing means 42 can comprise an air cylinder or other device to supply pressure to the polish head 30 as is conventional in the art. The pressure is important in controlling the overall CMP removal rate and uniformity.

Operation

In operation, the wafer 22 with the surface 23 to be polished directed about vertically is fixed to the wafer chuck 14, and the wafer chuck 14 is rotated at a speed of about 50 and 2000 rpm. At the same time, the slurries are supplied to the upper surface of the wafer 22 at a rate of between about 20 and 200 ml/min. The polishing head 30 is preferably not rotated. The polishing head 30 is optionally rotated at a speed of between about 40 and 1500 rpm, and the polishing surface 32 is pressed against the upper surface of the wafer 23 under a pressure of between about 100 and 1000 g/cm$^2$. Simultaneously, the polishing head 30 is reciprocally moved across the upper surface 23 of the wafer 22 to polish the wafer 22. The stroke of reciprocal movement of the polishing head 30 is preferably about the same as the radius of the wafer 22.

Preferably, the wafer chuck 14 is rotated at a speed ranging from 50 to 2000 rpm, the polishing surface 23 is preferably rotated at a speed ranging from 0 to 2000 rpm, and the polish head load exerts a pressure in the range of about 100 to 1000 g/cm$^2$.

The inventors have found that there is an unexpected increase in CMP polisher performance with the combination of at least two features of the invention: 1) polymer polish head (design and no polish pad), and 2) polymer polish head about 10% of area of wafer. In addition the inventors have found that there is an even greater unexpected increase in CMP polisher performance with the combination the two elements above and 3) vertical orientation of the wafer. The combination of these three elements provides an unexpected increase in CMP uniformity greater than using these three items individually.

Polish Head Conditioner Set Up

Figure 2:
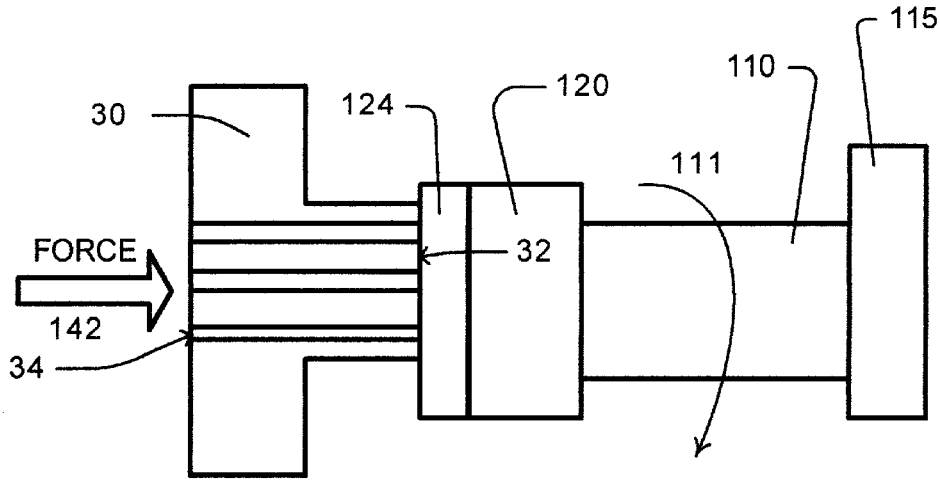
FIG. 2 is a front elevational view of a preferred embodiment of the polish surface dressing setup of the wafer polishing apparatus of the present invention.
Figure 3:
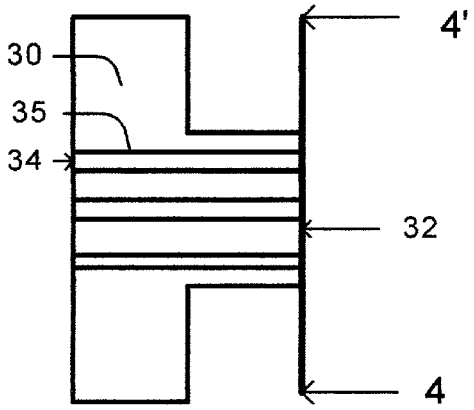
FIG. 3 is a cross sectional view of the polisher head of a preferred embodiment of the wafer polishing apparatus of the present invention.

FIG. 2 show the polish head conditioner set up. The invention's novel polymer polish head is conditioned as shown in FIG. 2. Here a vertical orientation is preferred because all debris or polish by-product is spun off during conditioning.

The polish surface 32 of the polish head is pressed against a diamond disk 124 that is held by a disk holder 120. A rotation motor 115 is connected to a spindle 110 that rotates 111 the diamond disk 124. The polish head is pressed against the disk 124 by a pressing means 142 such as a cylinder or other conventional methods. Preferably the polish surface and diamond disk surface have an about vertical orientation and are preferably between 0 and 2 degree from vertical.

The diamond disk conditions the polymer polish head by roughening the surface. When the grooves in the polish head are too shallow, the polish head is replaced.

Polish head conditioning is required to prevent removal non-uniformity by maintaining the surface roughness. It also opens up surface pores on the contact area of the polish head. These pores play an important role in holding the slurry abrasive particles and aid slurry transport to the wafer surface.

Advantages of the Invention

The invention has at least the following advantages.

The invention's polisher is especially effective when the wafer TTV (total thickness variation) is large and can improve post CMP film thickness uniformity.

Polishing debris will be spun off by centrifugal force. Hence no scratching due to debris as well as no contamination issues.

The conventional CMP polish pad is eliminated. The invention uses a polish head comprised of a solid block (can be hard or soft) with a small contact size.

As the invention's polish head is much smaller that the wafer, the contact area between the polishing head as well as the wafer is kept small. This reduces the temperature gradient of the polish head throughout the CMP process. This is useful for the implementation of the temperature end point control. In addition, as the polishing head is only about 10% of the wafer area, pad bending problem is eliminated.

As the invention's polish head does not rotate, the wafer can spin at very high speed to achieve better planarity. This makes the polish rate across the whole wafer surface more uniform.

The invention's polish head (no pad) and grooves provide uniform slurry distribution across the polish head and wafer.

The invention's polish head consumes less slurry because the slurry is delivered through the polish head and only the contact area needs to be flush with slurry. As the invention's head is smaller than the wafer diameter, the contact area is small. Hence slurry flow effects can be reduced significantly.

The invention's polisher reduces localized warpage. In conventional polishers localized warpage caused by downforce applied to the whole wafer. Wafer warpage is more severe when the TTV of the incoming wafer is large.

The invention's vertical wafer/polish head surface orientation allows the polisher tool to have a smaller foot print, especially for 300 mm technology.

Unless explicitly stated otherwise, each numerical value and range should be interpreted as being approximate as if the word "about" or "approximately" preceded the value or range. Also,the figures are not to scale.

While the invention has been particularly shown and described with reference to the preferred embodiments thereof, it will be understood by those skilled in the art that various changes in form and details may be made without departing from the spirit and scope of the invention. It is intended to cover various modifications and similar arrangements and procedures, and the scope of the appended claims therefore should be accorded the broadest interpretation so as to encompass all such modifications and similar arrangements and procedures.

What is claimed is:

1. A substrate polishing apparatus comprising:

a polishing head having a polishing surface which during use is adjacent to or contacting a substrate with a surface to be polished; said polish head consists essentially of a polymer;

said polishing surface of said polishing head is smaller than said surface of said substrate; and said polishing surface is comprised of a polymer;

said polishing surface does not comprise a polishing pad;

said polishing head has passage ways through which polishing solution flows to grooves in said polishing surface and flows to said substrate; said polishing head does not have a cavity; said polishing head has a solid surface except for said grooves.

2. The substrate polishing apparatus of claim 1 wherein said polishing surface has an about vertical orientation.

3. The substrate polishing apparatus of claim 1 wherein said polishing head is comprised of polyurethane.

4. The substrate polishing apparatus of claim 1 wherein said polishing head is one piece;

said polishing surface has grooves to allow said polishing solution to flow across said polish surface and said substrate; said grooves have a depth between 5 and 10 mm and a width between 2 mm and 6 mm.

5. The substrate polishing apparatus of claim 1 wherein said polishing head having an area between 5 and 15% of the area of said surface of said substrate.

6. The substrate polishing apparatus of claim 1 wherein said polish head consists of a polymer; said polishing surface does not comprise abrasive particles.

7. The substrate polishing apparatus of claim 1 wherein said polish head is solid.

8. The substrate polishing apparatus of claim 1 wherein said polish head has a square shaped polishing surface; said square shaped polishing surface had a length and width of between 2 and 5 cm;

said polishing head is one piece wherein said polishing surface has grooves to allow said polishing solution to flow across said polish surface and said substrate.

9. A substrate polishing apparatus comprising:

a polishing head having a polishing surface which is adjacent to or contacting a substrate with a surface to be polished during the polishing of said substrate; said substrate is used in semiconductor or electronic fabrication; said polishing head consists essentially of a polymer; said polishing head does not comprise abrasive particles;

said polishing surface of said polishing head is smaller than said surface of said substrate;

said polishing surface has grooves to allow said polishing solution to flow across said polish surface;

said polishing surface does not comprise a polishing pad;

said polishing head is comprised of one piece of molded polyurethane;

said polishing surface has an about vertical orientation;

said polish head has a square shaped polishing surface; said square shaped polishing surface had a length and width of between 2 and 5 cm; said polishing head is one solid piece; said grooves have a depth between 5 and 10 mm and a width between 2 and 6 mm; said grooves form a cross pattern.

10. The substrate polishing apparatus of claim 9 wherein said polishing head has a solid surface except for said grooves; said polishing head has passage ways where polishing solution flows to said substrate.

11. The substrate polishing apparatus of claim 9 wherein said grooves have a depth between 5 and 10 mm and a width between 2 and 6 mm; and said grooves form a cross pattern.

12. The substrate polishing apparatus of claim 9 wherein said polishing head has an area between 5 and 15% of the area of said surface of said substrate.

13. A substrate polishing apparatus comprising:

a) a substrate chuck for holding a substrate with a surface to be polished thereof being directed about vertically; said substrate is used in semiconductor or electronic fabrication;

b) a first drive means for rotating said substrate chuck;

c) a polishing head having a polishing surface which is adjacent to said substrate during the polishing of said substrate; said polishing surface of said polishing head is smaller than said surface of said substrate; said polishing surface comprised of a polymer; said polishing surface does not comprise a polishing pad;

d) polishing solution supply means for supplying a polishing solution through said polishing head to the substrate held by said substrate chuck;

e) reciprocating means for reciprocally moving said polishing head on said surface to be polished; and f) pressing means for pressing said polishing surface of said polishing head against a substrate held by said substrate chuck; said substrate polishing apparatus used in semiconductor or electronics fabrication;

a vacuum means for holding said substrate in said substrate chuck.

14. The substrate polishing apparatus of claim 13 wherein said polishing surface is orientated at an angle to the vertical between 0 and 2 degrees.

15. The substrate polishing apparatus according to claim 13 which further includes: said polishing head has an area between 5 and 15% of the area of said surface of said substrate.

16. The substrate polishing apparatus according to claim 13 which further includes: said polishing solution supply means comprises passage ways in said polishing head where polishing solution flows to said substrate.

17. The substrate polishing apparatus according to claim 13 wherein said polishing head is comprised of polyurethane.

18. The substrate polishing apparatus according to claim 13 wherein said polishing head is one solid piece wherein said polishing surface has grooves to allow said polishing solution to flow across said polish surface and said substrate; said grooves have a depth between 5 and 10 mm and a width between 2 and 6 mm; said polishing head is comprised of polyurethane.

19. The substrate polishing apparatus according to claim 13 which further includes: said polish head has a square shaped polishing surface; said square shaped polishing surface had a length and width of between 2 and 5 cm.

20. The substrate polishing apparatus according to claim 13 wherein said polishing head has a length and a width substantially equal to an interval of undulations of the substrate.

21. The substrate polishing apparatus according to claim 13 which further includes a diamond disk conditioning device.

22. The substrate polishing apparatus of claim 13 wherein said polishing surface of said polish head consists essentially of a polymer; said polishing surface does not comprise abrasive particles.

23. The substrate polishing apparatus of claim 13 wherein said polish head consists of a polymer.

24. A substrate polishing apparatus comprising:

a) a substrate chuck for holding a substrate with a surface to be polished thereof being directed about vertically; said substrate is used in semiconductor or electronic fabrication;

b) a vacuum means for holding said substrate in said substrate chuck;

c) a first drive means for rotating said substrate chuck;

d) a polishing head having a polishing surface which is adjacent to said substrate during the polishing of said substrate; said polishing surface of said polishing head is smaller than said surface of said substrate; said polishing head having an area between 5 and 15% of the area of said surface of said substrate; said polishing head is comprised of polyurethane; said polish head has a square shaped polishing surface; said square shaped polishing surface had a length and width of between 2 and 5 cm; said polishing surface does not comprise a polishing pad;

e) a polishing solution supply means for supplying a polishing solution through said polishing head to the substrate held by said substrate chuck; said polishing solution supply means comprises passage ways in said polishing head where polishing solution flows to said substrate;

f) a reciprocating means for reciprocally moving said polishing head on said surface to be polished; and g) a pressing means for pressing said polishing pad against a substrate held by said substrate chuck by way of said polishing head; said substrate polishing apparatus used in semiconductor or electronics fabrication.

25. The substrate polishing apparatus of claim 24 wherein said polishing surface is orientated at an angle to vertical between 0 and 2 degrees.

26. The substrate polishing apparatus according to claim 24 wherein said polishing head is one solid piece wherein said polishing surface has grooves to allow said polishing solution to flow across said polish surface and said substrate; said grooves have a depth between 5 and 10 mm and a width between 2 and 6 mm.

27. The substrate polishing apparatus according to claim 24 wherein said polishing head has a diameter substantially equal to an interval of undulations of the substrate.

28. The substrate polishing apparatus of claim 24 wherein said polishing surface of said polish head consists essentially of a polymer; said polishing surface does not comprise abrasive particles.

29. The substrate polishing apparatus of claim 24 wherein said polish head consists of a polymer.

30. A polishing head for a substrate polishing apparatus; said substrate polishing apparatus used in semiconductor or electronics fabrication; said polish head comprising:

a polishing head having a polishing surface which during operation is adjacent to or contacting a substrate with a surface to be polished; said substrate polishing apparatus used in semiconductor or electronics fabrication; and said polishing surface is comprised of a polymer said polishing surface does not comprise a polishing pad; said polish head consists essentially of a polymer; said polishing head does not comprise abrasive particles;

said polishing head has a square shape; and said polishing surface has grooves to allow said polishing solution to flow across said polish surface and said substrate.

31. The polishing head of claim 30 wherein said polishing head consists of polyurethane.

32. The polishing head of claim 30 wherein said polishing head has an area between 5 and 15% of the area of said surface of said substrate; said substrate used in semiconductor or electronic fabrication.

33. The polishing head of claim 30 wherein said polishing head is one piece;

said polishing surface has grooves to allow said polishing solution to flow across said polish surface and said substrate.

34. A method for polishing a substrate comprising:

polishing a substrate by contact with a polishing surface of a polishing head;

said substrate used in semiconductor or electronics fabrication, said polishing surface is comprised of a polymer; said polishing surface does not comprise a polishing pad: said polish surface of said polish head consists essentially of a polymer; said polish surface of said polishing head does not comprise abrasive particles;

said polish head has a square shaped polishing surface.

35. The method of claim 34 wherein said substrate is rotated at a speed between 50 and 200 rpm and said polishing head is stationary.

36. The method of claim 34 wherein said substrate is rotated at a speed between 50 and 200 rpm and said polishing surface is rotated at a speed ranging form 0 to 2000 rpm and said polishing head exerts a pressure in the range of 100 to 1000 g/cm2.

37. The method of claim 34 wherein said polishing surface has an about vertical orientation.

38. The method of claim 34 wherein said polishing head is comprised of polyurethane.

39. The method of claim 34 wherein said polishing head has an area between 5 and 15% of the area of said surface of said substrate.

40. The method of claim 34 wherein said polish head has a square shaped polishing surface; said square shaped polishing surface had a length and width of between 2 and 5 cm; said polishing head is one solid piece; said grooves have a depth between 5 and 10 mm and a width between 2 and 6 mm; said grooves form a cross pattern.

41. The method of claim 34 wherein said polish head consists of a polymer.

42. The method of claim 34 wherein said substrate has a substrate surface to be polished; said substrate surface is comprised of dielectric material;

said polish head consists essentially of a polymer.

43. The method of claim 34 wherein said polish head consists essentially of a polymer;

said substrate has a substrate surface to be polished; said substrate surface is comprised of dielectric material.

44. The method of claim 34 wherein said polish head consists essentially of a polymer;

said substrate has a substrate surface to be polished; said substrate surface is composed of a material selected from the group consisting of dielectric materials, conductive materials, or dielectric and conductive materials.

45. A method for polishing a substrate comprising:

polishing a substrate by contact with a polishing surface of a polishing head;

said substrate used in semiconductor or electronics fabrication, said polishing surface is comprised of a polymer; said polishing surface does not comprise a polishing pad;

said polish head has a square shaped polishing surface.

46. A substrate polishing apparatus comprising:

a polishing head having a polishing surface which during use is adjacent to or contacting a substrate with a surface to be polished; said polish head consists essentially of a polymer;

said polishing surface of said polishing head is smaller than said surface of said substrate; and said polishing surface is comprised of a polymer;

said polishing surface does not comprise a polishing pad;

said polish head has a square shaped polishing surface; said square shaped polishing surface had a length and width of between 2 and 5 cm;

said polishing head is one piece wherein said polishing surface has grooves to allow said polishing solution to flow across said polish surface and said substrate; and said grooves have a depth between 5 and 10 mm and a width between 2 and 6 mm.

* * * * *